United States Patent [19]

Kanno et al.

[11] Patent Number: 4,475,804

[45] Date of Patent: Oct. 9, 1984

[54] FIXING APPARATUS FOR COPYING MACHINE OR THE LIKE

[75] Inventors: Tadaaki Kanno, Yokosuka; Yuichiro Higashi, Kawasaki, both of Japan

[73] Assignee: Ricoh Company, Ltd., Tokyo, Japan

[21] Appl. No.: 475,412

[22] Filed: Mar. 14, 1983

[30] Foreign Application Priority Data

Mar. 18, 1982 [JP] Japan ..... 57-38198

[51] Int. Cl.[3] ..... G03G 15/00

[52] U.S. Cl. ..... 355/3 FU; 271/311

[58] Field of Search ..... 355/14 FU, 3 FU; 271/DIG. 2, 311, 308, 307

[56] References Cited

U.S. PATENT DOCUMENTS 4,384,781 5/1983 Takada ..... 355/3 FU

*Primary Examiner*—John Gonzales

*Assistant Examiner*—David Warren

*Attorney, Agent, or Firm*—David G. Alexander

[57] ABSTRACT

A fixing apparatus installed in a copying machine or the like and having a fixing roller, a pressure roller and sheet separator pawls engagable with the fixing roller. A first mechanism of the fixing apparatus is operable to locate free or separating ends of the sheet separator pawls at a small spacing from the periphery of the fixing roller. A pivotable second mechanism is operable to move the sheet separator pawls over a substantial distance away from the fixing and pressure rollers to define a large space in front thereof, so that the peripheries of the rollers become accessible for services.

12 Claims, 8 Drawing Figures

FIXING APPARATUS FOR COPYING MACHINE OR THE LIKE

BACKGROUND OF THE INVENTION

The present invention relates to a fixing apparatus for use with an electrophotographic copying machine or the like.

In one of prior art fixing apparatuses for copiers or the like, a fixing roller has a rubber layer thereon and a heater thereinside and is engaged by a pressure roller. These rollers are rotated to process a sheet fed thereto so that a toner or like material carried on the sheet is fixed permanently thereon. In this type of fixing apparatus, the toner, therefore the sheet, is apt to stick to the periphery of the fixing roller. It has been customary to employ sheet separator pawls which are resiliently engaged with the periphery of the fixing roller at their free ends, thereby forcibly peeling a leading end portion of a sheet from the fixing roller.

A problem has existed in such a type of fixing apparatus in that the sheet separator pawls, which are fixed in place, constitute an obstruction to the access when a sheet jammed between the fixing and pressure rollers has to be removed. Efforts heretofore made to solve this problem may be typified by designing a fixing apparatus so that the sheet separator pawls may be movable toward and away from the fixing roller. In this apparatus, upon sheet jam, the sheet separator pawls are moved clear of the fixing roller so that the sheet may be readily accessible through the open space around the fixing roller.

The sheet separator pawls so movable relative to the fixing roller are provided with a tendency that their free ends move toward the fixing roller at all the time. When the pawls are once spaced from the fixing roller for settling a sheet jam or for cleaning purpose and then moved back into contact with the fixing roller, their free or separating ends are apt to stick in the periphery (rubber layer) of the fixing roller due to the inherent tendency. This may disenable the pawls to restore the original position or damage the roller surface. Should the pawls be forcibly pulled out from the fixing roller, the free ends of the pawls and/or the periphery of the fixing roller would be damaged. Any damage to the roller surface will destruct an anti-offset layer on the roller to further enhance sticking of the sheet to the roller while allowing even the flaws to be transferred onto the surface of the sheet to be fixed.

SUMMARY OF THE INVENTION

It is an object of the present invention to provide a fixing apparatus for a copying machine or the like which causes sheet separator pawls into and out of contact with a fixing roller and, yet, safeguards the pawls and fixing roller against damage.

It is another object of the present invention to provide a generally improved fixing apparatus for a copying machine or the like.

A fixing apparatus embodying the present invention includes a housing, fixing roller means rotatably supported by the housing, pressure roller means rotatably supported by the housing in pressing contact with the fixing roller means, pivotable sheet separator pawl means for separating a leading end portion of an incoming sheet from the fixing roller means, engaging means for causing the sheet separator pawl means into engagement with the periphery of the fixing roller means, spacing means for spacing the sheet separator pawl means from the periphery of the fixing roller means, and a support member pivotally mounted on the housing and supporting the sheet separator pawl means, the engaging means and the spacing means.

In accordance with the present invention, a fixing apparatus is installed in a copying machine or the like and has a fixing roller, a pressure roller and sheet separator pawls engageable with the fixing roller. A first mechanism of the fixing apparatus is operable to locate free or separating ends of the sheet separator pawls at a small spacing from the periphery of the fixing roller. A pivotable second mechanism is operated to move the sheet separator pawls over a substantial distance away from the fixing and pressure rollers to define a large space in front thereof, so that the peripheries of the rollers become accessible for services.

DESCRIPTION OF THE PREFERRED EMBODIMENTS

While the fixing apparatus for a copying machine or the like of the present invention is susceptible of numerous physical embodiments, depending upon the environment and requirements of use, a substantial number of the herein shown and described embodiment have been made, tested and used, and all have performed in an eminently satisfactory manner.

Figure 1:
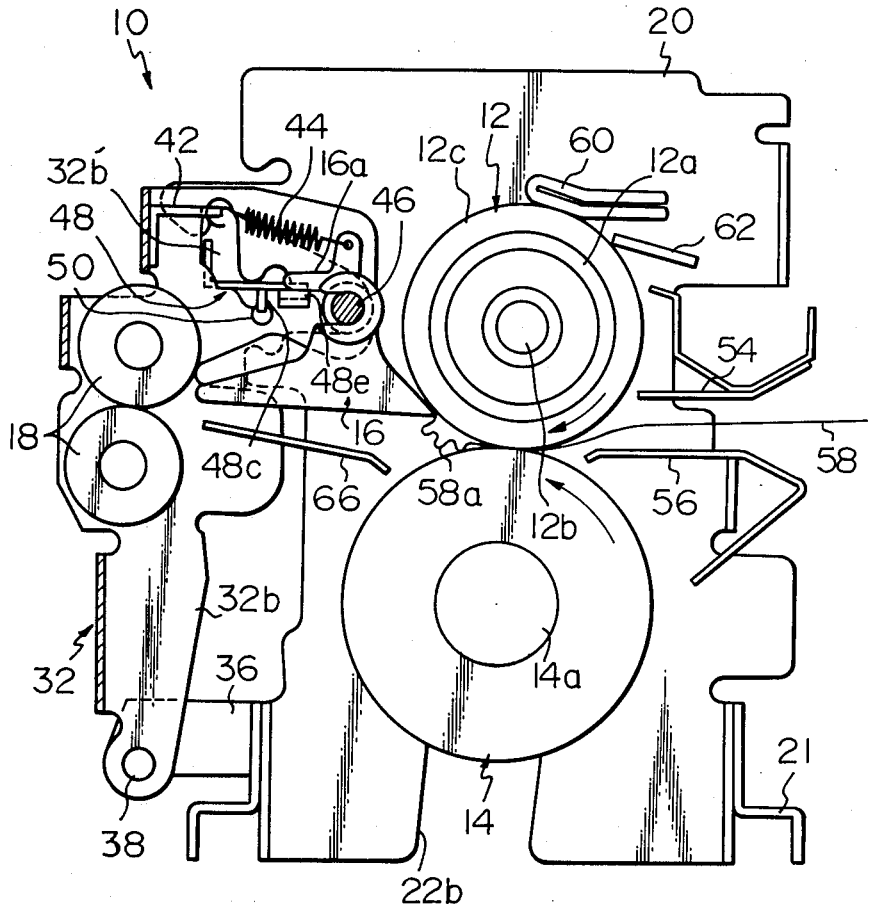
FIG. 1 is a sectional front view of a fixing apparatus embodying the present invention.

Referring to FIG. 1 of the drawings, the fixing apparatus generally designated by the reference numeral 10 comprises a fixing roller 12, a pressure roller 14, a sheet separator pawl 16, a pair of sheet feed rollers 18, a pair of side plates 20 and 22 (see FIG. 2 for the side plate 22) for rotatably supporting the rollers, etc.

Figure 2:
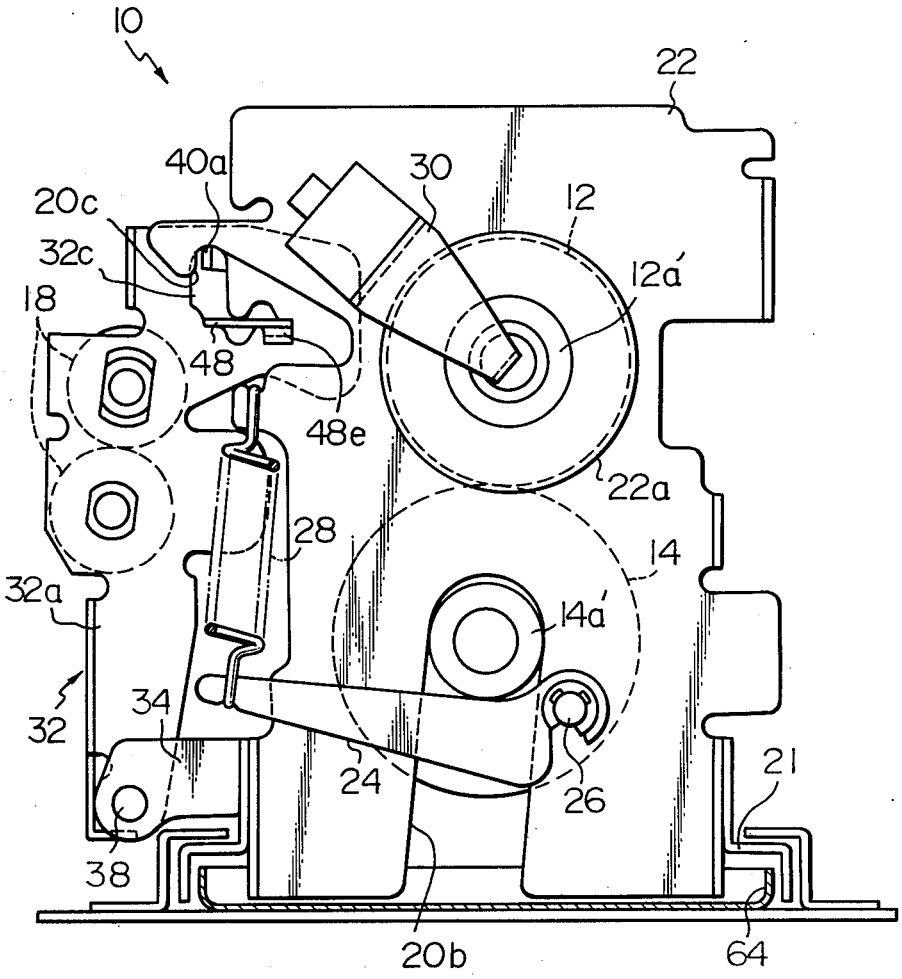
FIG. 2 is a front view of the fixing apparatus.

The fixing roller 12 includes a tubular metal shaft or sleeve **12*a* in which a heater 12*b* is positioned. A rubber layer 12*c* covers the outer periphery of the sleeve 12*a*. An anti-offset layer made of silicon rubber or the like is deposited on the rubber layer 12*c* to prevent a toner or the like from sticking to the rubber layer 12*c*. As shown in FIG. 2, the sleeve 12*a* has stepped opposite ends 12*a*' which are respectively passed through holes formed in the side plates 20 and 22. The outermost ends of stepped ends 12*a*' are rotatably supported by bearings 20*a* and 22*a* (20*a* is not shown) which are respectively arranged on the outer surfaces of the side plates 20 and 22 of a housing 21. A drive input gear (not shown) is rigidly mounted on the remote stepped end 12*a*' of the sleeve 12*a* with respect to the direction perpendicular to the sheet surface of FIG. 1. The gear element is in constant mesh with a drive gear (not shown) associated with a machine (e.g. copying machine) in which the fixing apparatus 10 is installed, so that clockwise rotation may be imparted to the fixing roller 12 as viewed in FIG. 1**.

The pressure roller 14 comprises a metal roller whose surface is treated with Teflon. A shaft 14*a* carrying the roller 14 extends outwardly throughout the side plates 20 and 22 at oppposite ends thereof 14*a*'. These ends of the shaft 14*a* are respectively rotatably coupled in generally U-shaped recesses 20*b* and 22*b* formed in the side plates 20 and 22 (see FIGS. 1 and 2). Each end 14*a*' is resiliently urged by a lever 24 such that the periphery of the pressure roller 14 is resiliently held in contact with the periphery of the fixing roller 10. The pressure roller 14 is rotatable on the shaft 14*a* so that it will follow the movement of the fixing roller 12 in contact therewith. When the levers 24 are removed, the pressure roller 14 will drop along the U-shaped reccesses 20*b* and 22*b* of the side plates 20 and 22. Each lever 24 is pivotally supported by a stub shaft 26 which is studded on the side wall 20 or 22 (the stub shaft on the side wall 22 is not shown). A coiled tension spring 28 is anchored at one end to the side plate and at the other end to the free end of the lever 24, whereby the pressure roller 14 is held in contact with the fixing roller 12 under pressure. The heater 12*b* inside the fixing roller 12 extends throughout the bore of the sleeve 12*a* to the outside of the side plates 20 and 22 and is retained at the opposite ends by electric terminal members 30. The terminal members 30 are mounted on the side plates 20 and 22 respectively (the terminal member on the side plate 22 is not shown).

An angle 32 which is separate from the side walls 20 and 22 is generally U-shaped in cross-section and supports the sheet separator pawl 16 and sheet feed roller pair 18.

The angle 32 includes a pair of ears 32*a* and 32*b* which are respectively located adjacent to and parallel to the side plates 20 and 22 and are pivotally supported through a stay 38 by brackets 34 and 36, which are integral with the side plates 20 and 22 respectively. Each ear 32*a* or 32*b* of the angle 32 is provided with a lock lever 40 at its top which is pivotable to lock the angle 32 to the side plates 20 and 22 in cooperation with the other lock lever 40 (see FIG. 3). Each lock lever 40 (the lock lever on the ear 32*b* side is not shown) has at its intermediate portion a lock member 40*a* which is engageable with a hook 20*c* which is formed in the side plate 20. The lock member 40*a* extends outwardly through a generally L-shaped opening 32*a*' which is located at the top of the ear 32*a*, corresponding in position to the hook 20*c* of the side plate 20 as will be described. The lock member 40*a* is provided with such a tendency that its upper edge remains in resilient contact with the upper end of the L-shaped opening 32*a*'. With this construction, when the lock member 40*a* is released from the hook 20*c*, the angle 32 will pivot counterclockwise about the stay 38 to the position shown in FIG. 3 where the sheet separator pawl 16 and sheet feed rollers 18 become spaced apart from the fixing roller 12. Usually, the lock member 40*a* of the lock lever 40 will be kept engaged with the hook 20*c* of the side plate 20 to maintain the free end of the sheet separator pawl 16 in resilient contact with the periphery of the fixing roller 12 as seen in FIG. 1.

Figure 4:
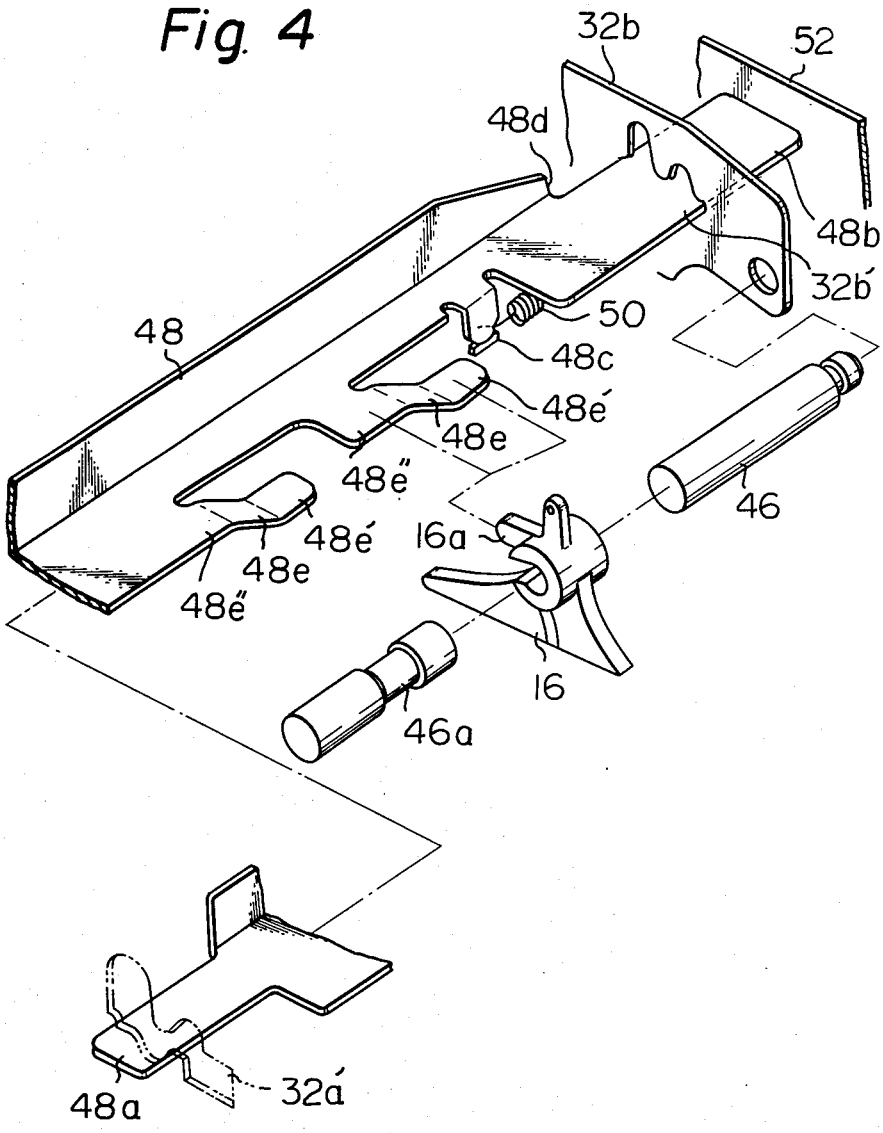
FIG. 4 is an exploded perspective view of a slide plate for moving the sheet separator pawls.
Figure 5:
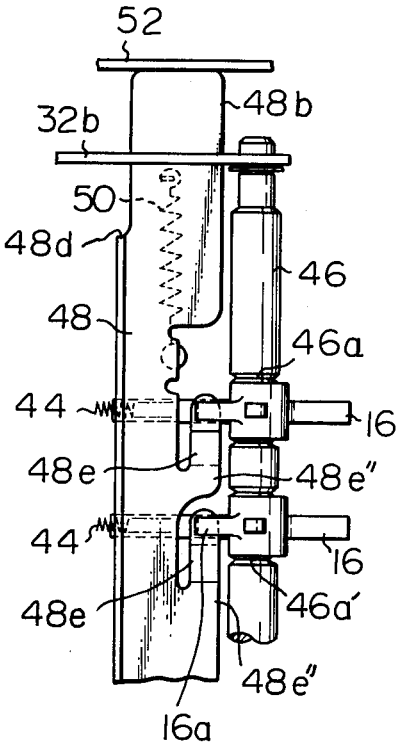
FIGS. 5 and 6 are fragmentary plan views of the slide plate and sheet separator pawls in different relative positions.

A tension spring 44 is anchored at one end to an arm 16*a* of the sheet separator pawl 16 and at the other end to a generally L-shaped lever 42 which is fixed to the angle 32 (see FIG. 1). The preload of the spring 44 is selected such that the end of the separator pawl 16 remains in light contact with the fixing roller 12. Such a separator pawl 16 is arranged at a plurality of locations along the axis of the fixing roller 12. In detail, a shaft 46 extends substantially parallel to the sleeve 12*a* of the fixing roller 12 and is retained by the free ends of the ears 32*a* and 32*b* of the angle 32. The sheet separator pawls 16 are individually pivotally mounted on reduced diameter portions 46*a* which are formed in the shaft 46 (see FIGS. 4–6). A slide lever or slider 48 having a generally L-shaped cross-section is loosely fit at opposite ends 48*a* and 48*b* thereof in the openings 32*a* and 32*b* of the ears 32*a* and 32*b* respectively (see FIG. 4). A tension spring 50 is loaded between a lug 48*c*, which extends downwardly from an edge of the slider 48 adjacent to the ear 32*b*, and the ear 32*b*, so that the end 48*b* of the slider 48 adjacent to the ear 32*b* (upper end in FIG. 5) tends to protrude outwardly beyond the ear 32*b*.

Figure 6:
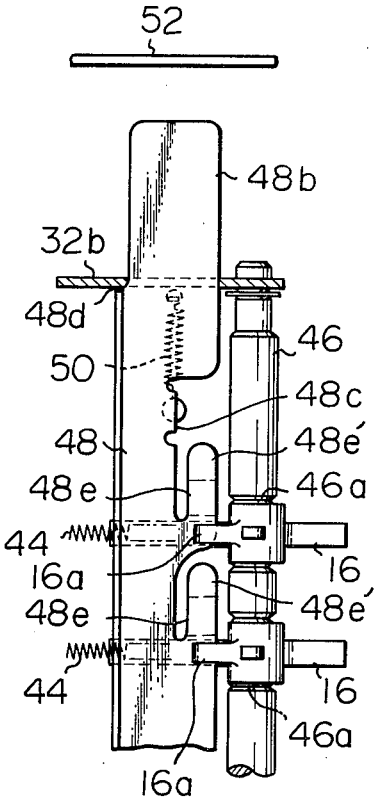

The fixing apparatus 10 described above is constructed as a unit which is bodily detachable from the copier or like machine. When the unit 10 is put into the machine, the end 48*b* of the slider 48 abuts against a rigid side panel 52 of the machine causing the slider 48 to be displaced toward the other ear 32*a* (downwardly in FIG. 5) against its tendency. Therefore, as the unit 10 is pulled out of the machine toward the ear 32*a*, the slider end 48*b* becomes clear of the machine side panel 52 and, as shown in FIG. 6, moves deeper toward the ear 32*b* until one side edge 48*d* of the slider 48 has been engaged with the ear 32*b*.

A lug 16*a* extends from the base portion of each sheet separator pawl 16 toward the slider 48. Tongues 48*e* extend from the slider 48 in correspondence with the lugs 16*a* such that they are positioned below the lugs 16*a* and oriented in the movable direction of the slider 48. As the fixing unit 10 is mounted in the machine (FIG. 5), the tongues 48*e* will be positioned below the lugs 16*a* at their free ends 48*e*'; as the fixing unit 10 is demounted from the machine (FIG. 6), the tongues 48*e* will be positioned below the lugs 16*a* at their base ends 48*e*'' due to the displacement of the slider 48 previously mentioned. The tongues 48 are shaped such that the free ends 48*e*' are at a level lower than the aligned lower edges of the lugs 16*a* and the base ends 48*e*'' are at a level higher than the same.

Suppose that a sheet 58 fed by a pair of guide plates 54 and 56 fixed to the side plates 20 and 22 has jammed at its leading end 58*a* in a position past of the rollers 12 and 14. Then, the operator pulls the fixing unit 10 out of the machine before removing the sheet 58. This causes the slider 48 to shift from the position shown in FIG. 5 to the position shown in FIG. 6 due to its tendency previously described, until the tongue base ends 48*e*'' become brought into register with the undersides of the lugs 16*a* of the sheet separator pawls 16. Because the tongue base ends 48*e*'' are higher in level than the undersides of the lugs 16*a* as already stated, they lift the lugs 16*a* from the level shown in FIG. 7 to the level shown in FIG. 8. Then, the sheet separator pawls 16 are individually rotated clockwise in FIG. 7 against the action of the spring 44 to have their ends disengaged from the fixing roller 12.

Figure 3:
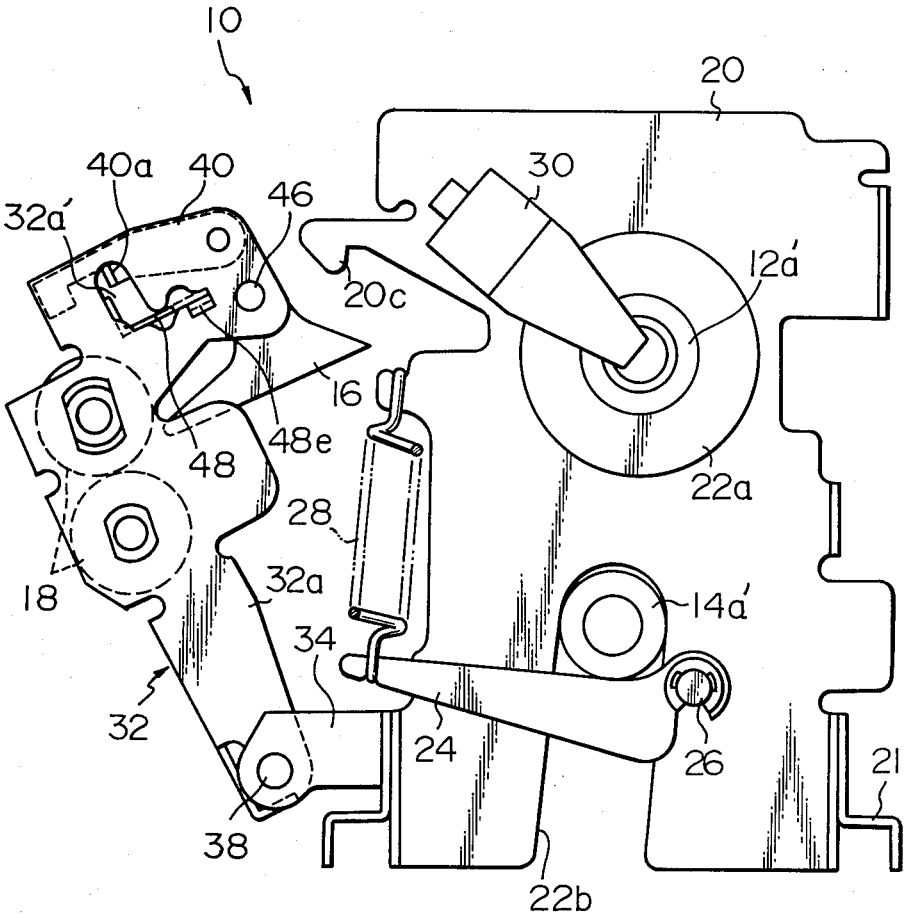
FIG. 3 is a front view of the fixing apparatus and showing sheet separator pawls in released position.

Thereafter, the operator releases the lock member 40*a* of the lock lever 40 from the hook 20*c* of the side plate 20 so that the angle 32 is allowed to swing about the stay 38 to the position shown in FIG. 3. In this situation, the periphery of the fixing roller 12 is exposed to the outside and the jamming sheet 58 is removed out of the fixing unit 10. After the removal of the sheet 58 which may be followed by cleaning of the roller 12, for example, the operator raises the angle 32 to the original position and locks it in place by engaging the lock member 40*a* to the hook 20*c*. In this instance, the ends of the separator pawls 16 have been moved by the tongue base ends 48*e*'' to a position clear of the periphery of the fixing roller 12 (see FIG. 8). This prevents the separator pawls 16 from damaging the roller surface, in contrast to the conventional separator pawls.

Figure 7:
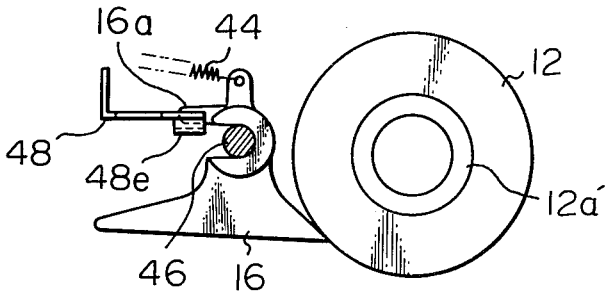
FIGS. 7 and 8 are fragmentary front views corresponding to FIGS. 5 and 6 respectively.
Figure 8:
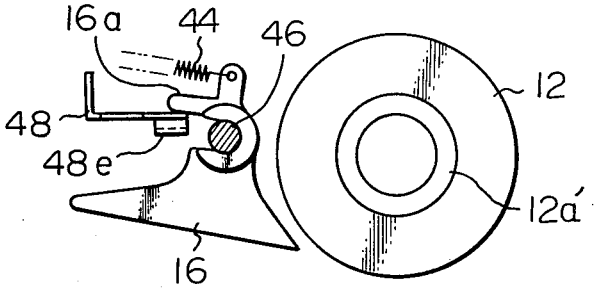

As the fixing unit 10 with the angle 32 restored to the locked position is put into the machine again, the slider end 48*b* is brought into contact with the machine side panel 52 to move the slider 48 toward the ear 32*a* against the tendency thereof (force of the spring 50). In accordance with the movement of the slider 48, the base ends 48*e*'' of its tongues 48*e* become disengaged from the lower edges of the lugs 16*a* (see FIG. 5) so that the ends of the separator pawls 16 are individually caused into resilient contact with the fixing roller 12 (FIG. 7). Although the free ends 48*e*' of the tongues 48*e* are registered with the lower edges of the lugs 16*a* in the above situation, they will not interfere with the angular movement of the separator pawls 16 into contact with the fixing roller 12 due to their position lower than the lower edges of the lugs 16*a*.

The sheet feed rollers 18 are individually journalled to the ears 32*a* and 32*b* of the angle 32. The shaft carrying driving one (lower one in FIG. 1) of the rollers 18 extends throughout the ear 32*b* to the outside where a drive input gear (not shown) is mounted to mesh with a drive gear, which is mounted on the machine. This drive input gear will become disengaged from the drive gear and the drive input gear associated with the fixing roller 12 from the previously mentioned drive gear, when the fixing unit 10 is pulled out of the machine.

An oil pad 60 is engaged with the periphery of the fixing roller 12 to facilitate separation of a sheet from the fixing roller 12. Also engaged with the fixing roller 12 is a cleaning blade 62 adapted to clean the periphery thereof. A tray 64 (see FIG. 2) is laid on the bottom of the fixing unit 10 in order to receive oil, dust, etc. The angle 32 is provided with a guide plate 66 along which the sheet 56 separated from the fixing roller 12 will be moved toward the sheet feed roller pair 18.

In summary, it will be seen that the present invention provides a fixing apparatus in which sheet separator pawls are prevented from damaging the surface of a fixing roller when moved into and out of contact with the fixing roller. This is because the sheet separator pawls become spaced from the roller surface before the fixing unit is demounted from a machine, in which the fixing unit is installed.

Various modifications will become possible for those skilled in the art after receiving the teachings of the present disclosure without departing from the scope thereof.

What is claimed is:

1. A fixing apparatus comprising:

a housing;

fixing roller means rotatably supported by said housing;

pressure roller means rotatably supported by the housing in pressing contact with said fixing roller means;

pivotable sheet separator pawl means for separating a leading end portion of an incoming sheet from the fixing roller means;

engaging means for causing the sheet separator pawl means into engagement with the periphery of the fixing roller means;

spacing means for spacing the sheet separator pawl means from the periphery of the fixing roller means; and a support member pivotally mounted on the housing and supporting the sheet separator pawl means, the engaging means and the spacing means;

the housing being detachable from a machine in which the apparatus is installed;

the spacing means spacing the sheet separator pawl means from the fixing roller means in interlocked relation with an operation with an operation for detaching the housing from the machine.

2. A fixing apparatus as claimed in claim 1, in which the support member also supports a pair of rollers for feeding a sheet after fixation.

3. A fixing apparatus as claimed in claim 2, in which the support member also supports a guide member for guiding the sheet toward the roller pair.

4. A fixing apparatus as claimed in claim 1, in which the housing comprises a locking member, the support member comprising a locking member which is engagable with said locking member of the housing to lock the support member to the housing.

5. A fixing apparatus as claimed in claim 4, in which when the locking member of the housing and the locking member of the support member are disengaged from each other, the support member is moved a substantial angular distance away from the housing so that the periphery of the fixing roller means and that of the pressure roller means are exposed to the outside through a substantial space which is defined in front of the roller means.

6. A fixing apparatus as claimed in claim 1, in which the support member supports a guide member for guiding a sheet after fixation.

7. A fixing apparatus comprising:

a housing;

fixing roller means rotatably supported by said housing;

pressure roller means rotatably supported by the housing in pressing contact with said fixing roller means;

pivotal sheet separator pawl means for separating a leading end portion of an incoming sheet from the fixing roller means;

engaging means for causing the sheet separator pawl means into engagement with the periphery of the fixing roller means;

spacing means for spacing the sheet separator pawl means from the periphery of the fixing roller means; and a support member pivotally mounted on the housing and supporting the sheet separator pawl means, the engaging means and the spacing means;

the housing being detachable from a machine in which the apparatus is installed;

the sheet separator pawl means comprising an engaging member which is rotatable about a shaft, the spacing means comprising a slide lever formed with an engaging member which is engagable with said engaging member of the sheet separator pawl means, the sheet separator pawl means being rotated through the engaging members out of contact with the periphery of the fixing roller means in response to a movement of the slide lever in one direction and into contact with the periphery of the fixing roller in response to a movement of the slide lever in the other direction.

8. A fixing apparatus as claimed in claim 7, in which the support member also supports a pair of rollers for feeding a sheet after fixation.

9. A fixing apparatus as claimed in claim 8, in which the support member also supports a guide member for guiding the sheet toward the roller pair.

10. A fixing apparatus as claimed in claim 9, in which the housing comprises a locking member, the support member comprising a locking member which is engagable with said locking member of the housing to lock the support member to the housing.

11. A fixing apparatus as claimed in claim 10, in which when the locking member of the housing and the locking member of the support member are disengaged from each other, the support member is moved a substantial angular distance away from the housing so that the periphery of the fixing roller means and that of the pressure roller means are exposed to the outside through a substantial space which is defined in front of the roller means.

12. A fixing apparatus as claimed in claim 7, in which the support member supports a guide member for guiding a sheet after fixation.

* * * * *